United States Patent [19]

Wikstrom

[11] 4,218,180

[45] Aug. 19, 1980

[54] COMPACT TURBO MACHINE

[75] Inventor: Rolf Wikstrom, Finspong, Sweden

[73] Assignee: Stal-Laval Turbin AB, Sweden

[21] Appl. No.: 922,252

[22] Filed: Jul. 5, 1978

[30] Foreign Application Priority Data

Jul. 12, 1977 [SE] Sweden ..... 7708074

[51] Int. Cl.[2] ..... F01D 25/24; F01D 9/02

[52] U.S. Cl. ..... 415/138; 415/199.5; 415/218

[58] Field of Search ..... 415/136, 137, 138, 139, 415/199.5, 218, 108

[56] References Cited

U.S. PATENT DOCUMENTS

| | | | |
|---|---|---|---|
| 1,288,360 | 12/1918 | Zaar | 415/199.5 X |
| 1,666,626 | 4/1928 | Losel | 415/108 |
| 1,692,537 | 11/1928 | Baumann | 415/136 |
| 1,745,429 | 2/1930 | Lysholm | 415/199.5 X |
| 1,873,743 | 8/1932 | Doran | 415/136 |

FOREIGN PATENT DOCUMENTS

| | | | |
|---|---|---|---|
| 1055548 | 4/1959 | Fed. Rep. of Germany | 415/108 |
| 675248 | 2/1930 | France | 415/199.5 |
| 700859 | 12/1953 | United Kingdom | 415/139 |

*Primary Examiner*—Leonard E. Smith

*Attorney, Agent, or Firm*—Pollock, Vande Sande & Priddy

[57] ABSTRACT

A novel turbo-machine of the axial type including a rotor assembly rotatably supported within a stator housing, wherein the stator housing includes a plurality of partition wall sections, with each section supported within a separate ring member along a limited contact surface, and with each of the ring members attached to each other and to the stator housing in a manner ensuring proper alignment of the turbine assembly.

8 Claims, 5 Drawing Figures

Fig. 1
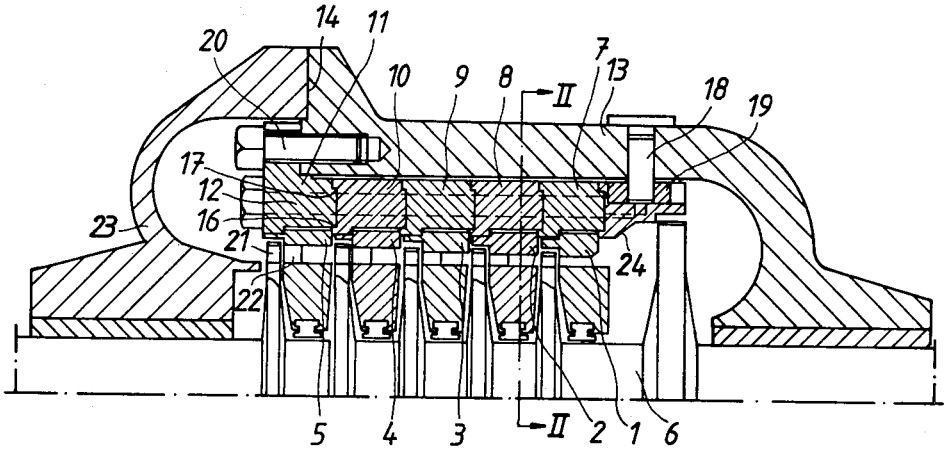
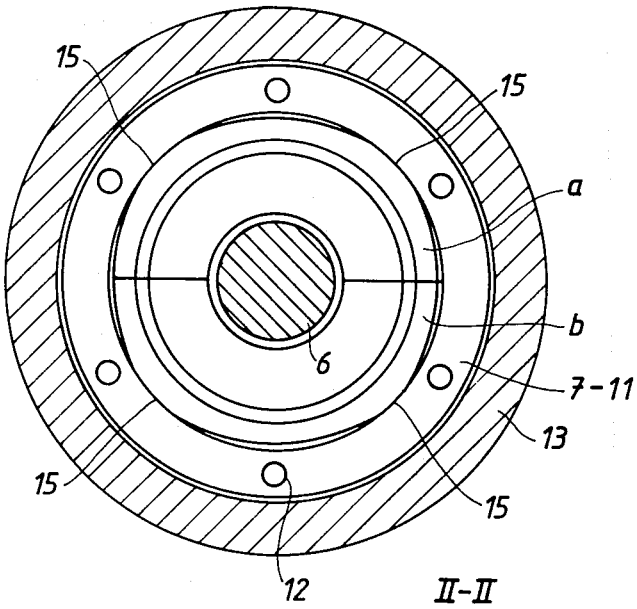
Fig. 2

IV-IV

V-V

COMPACT TURBO MACHINE

BACKGROUND OF THE INVENTION

The present invention relates to a turbo-machine of the axial type, generally similar to the assembly disclosed in copending application Ser. No. 922,254 filed on July 5, 1978 by the same inventor as the present application, and incorporated by reference thereto. In particular, the present invention is directed to a compact turbine structure including a rotor assembly surrounded by and supported within a novel, composite stator housing assembly.

Conventional turbine assemblies face the problem of stator misalignment as a result of thermal expansion in the axial and radial directions. As the stator becomes increasingly misaligned, the efficiency of the turbine is reduced and extensive damage may result if the stator comes into contact with the rotary blade members. A further problem facing known turbine assemblies is the difficulty of mounting the stator housing around the rotor assembly while properly positioning guide members between the individual blades.

As will be discussed in detail hereinafter, applicant's new and useful invention overcomes the problems of assembly, and more importantly, overcomes the problem of stator thermal expansion while at the same time providing a compact turbine structure which ensures proper alignment between rotor and stator assemblies.

OBJECTS OF THE PRESENT INVENTION

An object of the present invention is to provide a novel turbo-machine assembly including a plurality of wall sections which are positionally aligned by a further plurality of rings positioned adjacent thereto.

A further object of the present invention is to provide a turbo-machine, wherein the ring members are fixedly aligned relative to each other.

Another object of the present invention is to form a turbo-machine, wherein the partition wall sections each join a surrounding ring member along a limited line of contact to allow for variable rates of thermal expansion of the members.

These and other objects of the present invention will become apparent from a reading of the following specification and claims, together with the accompanying drawings, wherein similar elements are referred to and are indicated by similar reference numerals.

BRIEF DESCRIPTION OF THE DRAWINGS

The present invention can be best understood with reference to the accompanying drawings, wherein:

FIG. 1 shows an axial through a turbine constructed according to a preferred embodiment of the present invention;

FIG. 2 shows a cross-sectional view of the preferred embodiment of FIG. 1 taken along section lines II—II;

DETAILED DESCRIPTION OF A PREFERRED EMBODIMENT

Figure 3:
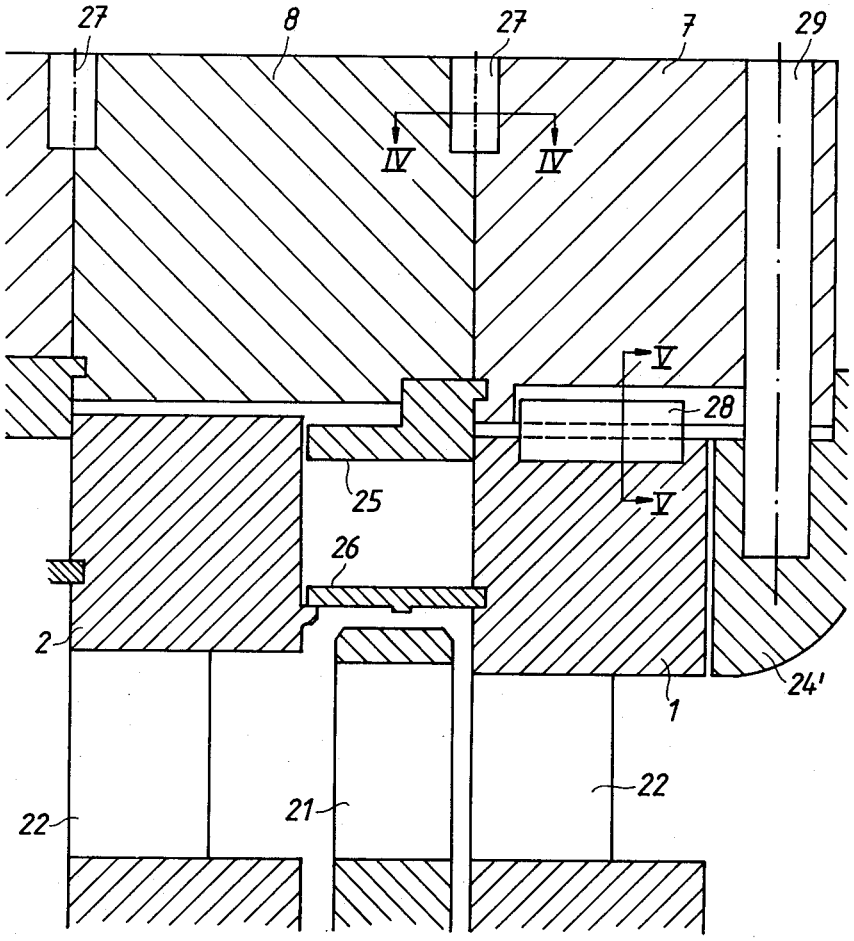
FIG. 3 shows a partial axial section of an alternative embodiment of the present invention.

Referring to the drawings, and FIGS. 1 and 2 in particular, a turbo-machine is shown as comprising a rotor assembly 6 rotatably supported within a stator housing 13. An end portion of housing 13 forms a first bearing for rotor 6, while a separate end wall 23, attached to housing 13 at end section 14, forms a second bearing for rotor assembly 6.

Stator housing 13 includes a plurality of partition wall sections 1–5, with each wall section being attached to a guide vane 22. Rotor assembly 6 includes a plurality of spaced rotor blades 21 which are attached to a rotatable shaft, with each blade 21 extending between a pair of adjacent vanes 22 as shown in FIG. 1. Each of the wall sections 1–5 is generally circular in shape and is divided into two semi-circular members a, b, respectively, by a diametrical section extending therethrough.

Each of the pairs of semi-circular members a, b are positioned axially adjacent to one another and are held in place by a plurality of ring-shaped members 7–11, with each ring 7–11 surrounding a separate wall section 1–5, respectively. To allow for varying rates of thermal expansion between wall sections 1–5 and rings 7–11, outer circumferential surface of each wall section 15 has been milled along selective portions. As a result, only a limited surface portion of wall sections 1–5 initially contacts rings 7–11, respectively, with additional contact occuring as a result of relative thermal expansion between the members. The wall sections 1–5 may be secured against relative rotation within rings 7–11 by extending dowels between the members (not shown).

To properly align adjacent ring members 7–11, facing surfaces of adjacent rings may be formed with either a recess or a mating edge section 16 or 17, respectively. In this manner, recess and edge sections 16, 17 are brought into engagement to properly align adjacent rings. Additionally, each of the rings 7–11 is formed with a radial cavity and associated edge for axially positioning an adjacent wall section 1–5 extending radially inwardly thereof.

Ring members 7–11 each include a plurality of alignable apertures, through which a plurality of bolts 12 are extendable so as to clamp ring members 7–11 into a single assembly. At the right-hand portion of FIG. 1 an additional ring member 24 is positioned adjacent to ring member 7 and wall section 1, with ring member 24 maintaining wall section 1 in proper position relative to surrounding ring member 7.

A flange member extends from ring member 11 in the direction of stator housing 13 and includes a plurality of apertures alignable with a plurality of apertures formed in housing 13. A plurality of bolts 20 extend axially through the aligned apertures, fixedly attaching ring assembly 7–11 to housing 13. Attached ring assembly 7–11 is also joined to housing 13 through a plurality of bolts of pins 18, extending radially through apertures in housing 13 and into sliding shoes 19. Each sliding shoe 19 is positioned in a recess formed in ring member 24. As a result, the stator assembly may undergo both axial and radial thermal expansion while maintaining proper alignment relative to rotor assembly 6.

Figure 4:
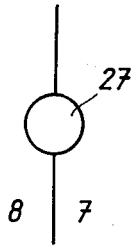
FIGS. 4, 5 show detailed sections of the structure of FIG. 3.
Figure 5:
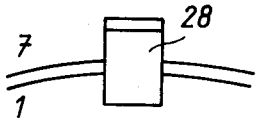

An alternate embodiment of the present invention will now be explained with reference to FIGS. 3–5, respectively. Turning to FIG. 3, a section between wall sections 1,2 and ring members 7, 8 is shown. Both the wall sections 1, 2 and ring members 7, 8 are formed with slots for supporting a pair of concentrically spaced rings 25 and 26, respectively. Rings 25 and 26 function to properly align adjacent wall sections 1–5 relative to one another.

A plurality of at least three radially extending pin members 27 may be positioned in aligned slots formed in each pair of adjacent ring members 7–11 to ensure proper positioning of the ring members relative to one another. In the case of larger turbine assemblies, pin members 27 may be preferable to the recesses and edges 16, 17 described with respect to the embodiment of FIG. 1. To properly guide wall sections 1–5 with their respective ring members 7–11, wedges 28 may be positioned in aligned slots formed in edge surfaces of adjacent members, with the edge surfaces being initially out of contact with each other, to allow for thermal expansion as shown in FIG. 5. In the case of large diameter wall sections and ring members, wedges 28 may be preferable to the milled-out portions 15 formed on the outer surfaces of wall sections 1–5. Finally, end ring member 24' may be attached to ring member 7 via a plurality of stud bolts, one of which is shown in FIG. 3 at 29.

The present invention is not limited to the above-described embodiment, but is limited only by the scope of the following claims.

What I claim is:

1. A turbo-machine of the axial type comprising:

a rotor assembly including a plurality of axially spaced rotor blades each extending from a rotor shaft;

a stator assembly including a stator housing surrounding said rotor assembly, with opposed end portions of said stator housing contacting and forming bearing surfaces with portions of said rotor shaft;

a plurality of divided partition wall sections axially spaced from one another within said stator housing, with each partition wall section including a guide vane assembly attached thereto, said divided partition wall sections being positioned such that a separate rotor blade extends between each pair of adjacent vane assemblies;

a plurality of continuous guide ring members equal in number to said partition wall sections also positioned within said stator housing, with each of said guide ring members surrounding and supporting a separate divided partition wall section;

means for attaching each of said partition wall sections to a surrounding guide ring member to allow for relative radial thermal expansion between said partition wall segment and said surrounding guide ring member;

wherein said means comprises outer wall surfaces of said partition wall sections initially contacting inner wall surfaces of said respective surrounding ring members only at a plurality of circumferentially spaced portions to allow for thermal expansion of said partition wall sections relative to said respective surrounding ring members; and further means for attaching said ring members to said stator housing to allow for both axial and radial thermal expansion of said rings relative to said housing during operation of said turbo-machine.

2. A turbo-machine according to claim 1, wherein each of said partition wall sections includes a guide vane assembly extending between adjacent rotor blades;

and each of said wall sections further includes a groove formed in a surface to prevent contact with a tip portion of said rotor blade.

3. A turbo-machine according to claim 1, wherein each ring member includes a plurality of apertures extending therethrough which are alignable with apertures formed in adjacent ring members, and a plurality of bolts each extend through said aligned apertures to join said ring members into an integral assembly.

4. A turbo-machine according to claim 1, wherein each ring member includes a slot extending radially inwardly from an outer surface and alignable with a slot formed on an adjacent ring member, and a plurality of pin members each extend into said aligned slots to center and attach said adjacent ring members to each other.

5. A turbo-machine according to claim 1, wherein said further means comprises a first plurality of bolts extending axially through a plurality of aligned apertures formed through a flange attached to said first ring member and said stator housing, said further means also comprising a further plurality of bolts extending radially between a further ring member and said housing.

6. A turbo-machine according to claim 1, wherein each ring member is formed with a plurality of circumferentially spaced slots extending radially inwardly from an outer surface thereof, with the slots formed in adjacently disposed ring members being axially alignable with one another to form a plurality of circumferentially spaced pairs of slots, said turbo-machine further including a plurality of pin members, with a separate pin member extending into each pair of axially aligned slots to ensure proper orientation of said ring members relative to one another.

7. A turbo-machine according to claim 1, wherein each pair of adjacent ring members includes aligning means for mutually centering said ring members relative to each other.

8. A turbo-machine according to claim 7, wherein said aligning means comprises a recess formed in one of said ring members and a mating edge extending from an adjacent ring member and positionable within said recess to properly align said ring members.

* * * * *